US008079854B2

(12) United States Patent
He et al.

(10) Patent No.: US 8,079,854 B2
(45) Date of Patent: Dec. 20, 2011

(54) CONNECTOR HAVING IMPROVED CONTACTS ARRANGEMENT

(75) Inventors: Jia-Yong He, Kunshan (CN); Qi-Sheng Zheng, Kunshan (CN); Zhong-Hua Yao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/097,077

(22) Filed: Apr. 29, 2011

(65) Prior Publication Data

US 2011/0269341 A1 Nov. 3, 2011

(30) Foreign Application Priority Data

Apr. 30, 2010 (CN) ..... 2010 1 0161118

(51) Int. Cl.
*H01R 12/00* (2006.01)

(52) U.S. Cl. ..... 439/108; 439/660

(58) Field of Classification Search ..... 439/78–80, 439/83–85, 733.1, 108, 660
See application file for complete search history.

(56) References Cited

U.S. PATENT DOCUMENTS

| | | | | |
|---|---|---|---|---|
| 7,618,293 | B2 * | 11/2009 | Wu | 439/660 |
| 7,806,704 | B2 * | 10/2010 | Miyoshi et al. | 439/108 |
| 7,883,371 | B1 * | 2/2011 | Chen et al. | 439/607.41 |
| 7,972,151 | B2 * | 7/2011 | He et al. | 439/108 |
| 2010/0055987 | A1 * | 3/2010 | Zheng et al. | 439/660 |
| 2010/0173529 | A1 * | 7/2010 | He et al. | 439/660 |
| 2010/0227569 | A1 * | 9/2010 | Bala et al. | 455/73 |
| 2010/0322570 | A1 * | 12/2010 | Zheng et al. | 385/93 |
| 2011/0097043 | A1 * | 4/2011 | He et al. | 385/75 |
| 2011/0159746 | A1 * | 6/2011 | He | 439/660 |

FOREIGN PATENT DOCUMENTS

| | | |
|---|---|---|
| TW | M359828 | 6/2009 |
| TW | M363140 | 8/2009 |

* cited by examiner

*Primary Examiner* — Neil Abrams
*Assistant Examiner* — Phuong Nguyen
(74) *Attorney, Agent, or Firm* — Wei Te Chung; Andrew C. Cheng; Ming Chieh Chang

(57) ABSTRACT

A connector includes an insulative housing having a mating port; and a set of first contacts; and a set of second contacts disposed in the insulative housing. The first contacts include a power contact, a first grounding contact and a first pair of differential contacts. Each of the first contacts includes a first contacting portion exposed in the mating port and a first tail portion. The second contacts include a second pair of differential contacts, a third pair of differential contacts, and a second grounding contact. Each of the second contacts includes a second contacting portion exposed in the mating port, and a second tail portion. The first and second tail portions are arranged in one row in a transverse direction wherein all of the second tail portions are located between the first tail portions of the power contact and of the first grounding contact in the transverse direction.

19 Claims, 10 Drawing Sheets

CONNECTOR HAVING IMPROVED CONTACTS ARRANGEMENT

BACKGROUND OF THE INVENTION

1. Field of the Invention

The present invention relates to a connector, and more particularly to a connector having improved contacts arrangement.

2. Description of Related Art

USB (Universal Serial Bus) connectors are widely adopted to connect electronic devices such as digital cameras, mobile phones and the like to a computer. The design of USB is standardized by the USB Implementers Forum (USB-IF) and has been under development for years. The recent design of the USB is USB 3.0 (SuperSpeed USB) which is disclosed in the USB 3.0 specification released on Nov. 17, 2008 by the USB-IF. Compared to an USB 2.0 plug connector, the USB 3.0 standard A-type plug connector usually comprises four contacts adapted for USB 2.0 protocol and five additional contacts comprising two pairs of differential contacts added thereto, thereby increasing transfer rate.

In order to satisfy a wide range of requirements, the tail portions of the four contacts and the five contacts are usually arranged in one row or two rows. However, when the tail portions are arranged in one row, the four contacts and the five contacts are usually staggered with each other at the tail portions, the distance between tail portions of each pair of the differential contacts will be increased by the staggered arrangement, and all the tail portions are not positioned in a desirable way to cooperate with each other to decrease crosstalk.

Hence, an improved connector with an improved contacts arrangement is desired to overcome the above problems.

BRIEF SUMMARY OF THE INVENTION

According to one aspect of the present invention, a connector comprises: an insulative housing defining a mating port; a plurality of first contacts disposed in the insulative housing and comprising a power contact, a first grounding contact and a first pair of differential contacts located between the power contact and the first grounding contact; and a plurality of second contacts disposed in the insulative housing and being configured essentially different from the first contacts. Each of said first contacts comprises a first contacting portion exposed in the mating port and a first tail portion opposite to the first contacting portion. The second contacts comprise a second pair of differential contacts, a third pair of differential contacts, and a second grounding contact located between the second and third pairs of differential contacts. Each of said second contacts comprises a second contacting portion exposed in the mating port and essentially located at a different level with regard to the first contacting portion, and a first tail portion opposite to the first contacting portion. The first and second tail portions are arranged in one row in a transverse direction under a condition that all of the second tail portions are located between the first tail portions of the power contact and the first grounding contact in said transverse direction.

According to another aspect of the present invention, a USB 3.0 plug connector comprises: an insulative housing having a base portion and a tongue portion extending forwardly from the base portion; and a plurality of USB 3.0 contacts coupled to the insulative housing and comprising a plurality of first contacts adapted for USB 2.0 protocol and a plurality of second contacts. The first contacts comprise a power contact, a first grounding contact and a first pair of differential contacts located between the power contact and the first grounding contact. Each of said first contacts comprises a stiff first contacting portion retained in the tongue portion and a first tail portion opposite to the first contacting portion. The second contacts comprise a second pair of differential contacts, a third pair of differential contacts, and a second grounding contact located between the second and third pairs of differential contacts. Each of said second contacts comprises a resilient second contacting portion extending upon the tongue portion under a condition that the second contacting portions are located behind the first contacting portions, and a second tail portion opposite to the second contacting portion. The first and second tail portions are arranged in one row in a transverse direction. The second grounding contact defines two split said second tail portions spaced from each other in said transverse direction. The first tail portions of the first pair of differential contacts are arranged between and directly neighboring to said second tail portions of the second grounding contact.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details.

Figure 1:
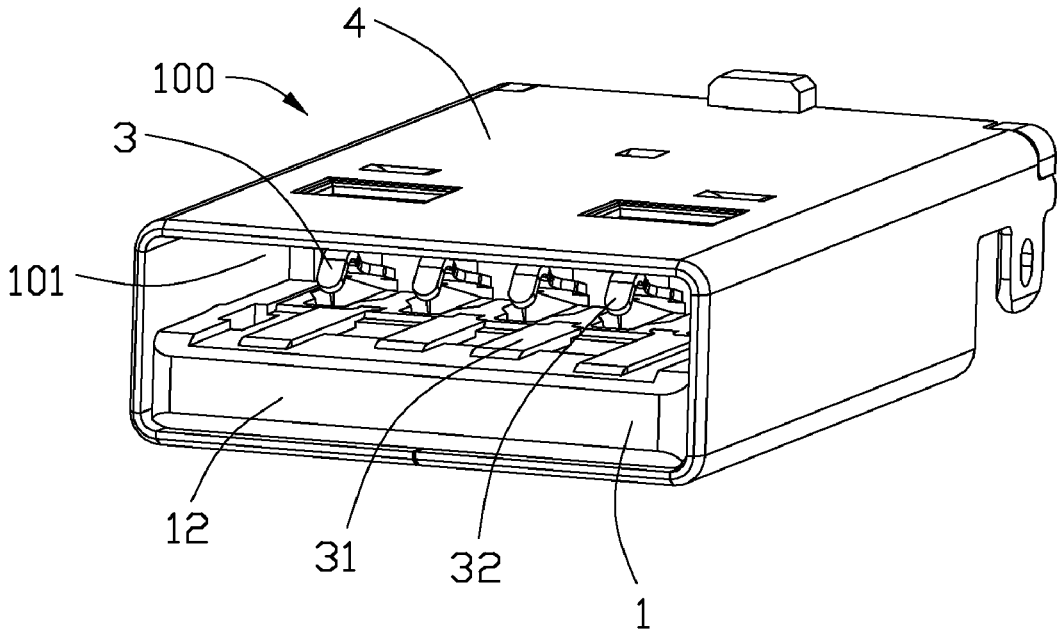
FIG. 1 is an assembled, perspective view of a connector according to a first embodiment of the present invention.
Figure 2:
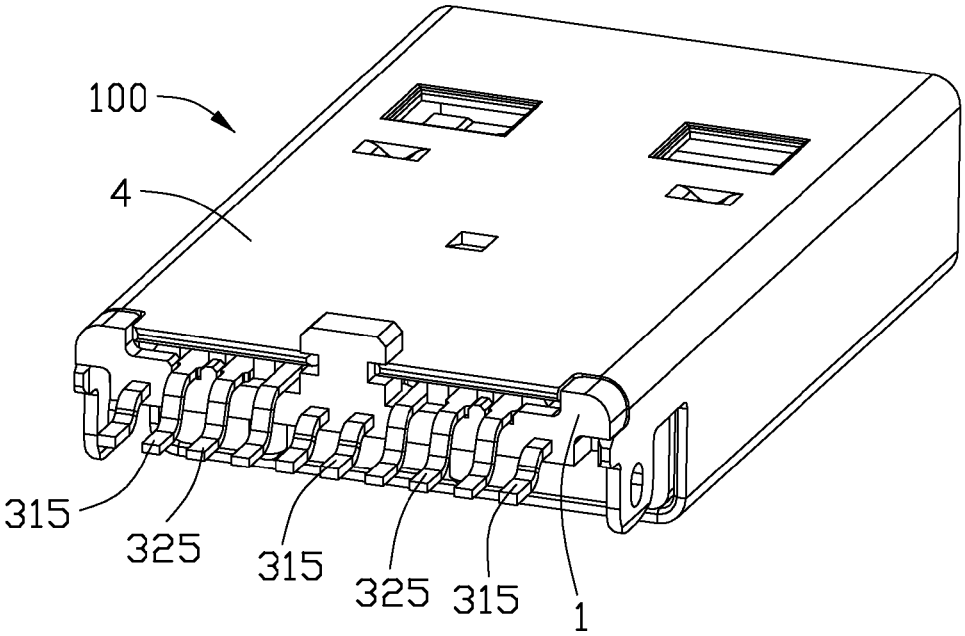
FIG. 2 is similar to FIG. 1, but viewed from another aspect.
Figure 3:
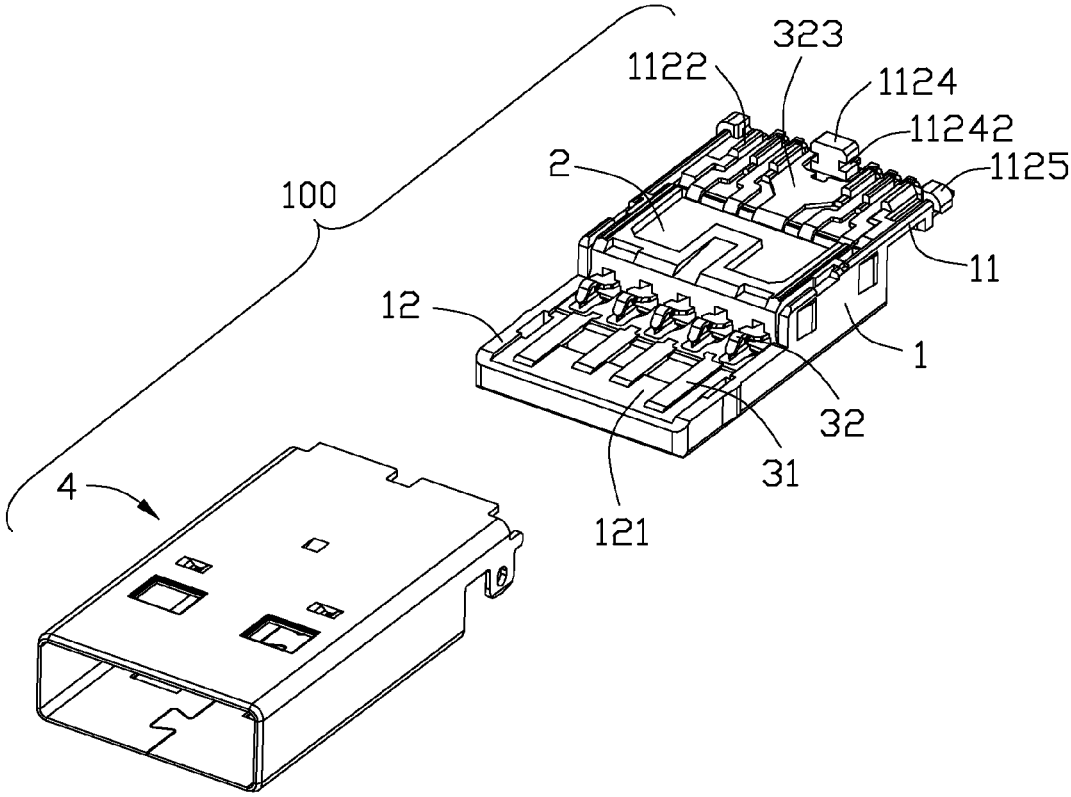
FIG. 3 is a partially exploded view of the connector shown in FIG. 1.

Referring to FIGS. 1-3, a connector 100 according to a first embodiment of the present invention is an A type USB 3.0 plug connector and defines an interface 101. The connector 100 comprises an insulative housing 1, a set of contacts 3 coupled to the insulative housing 1, an insulator 2 coupled to the insulative housing 1, and a metal shell 4 shielding the insulative housing 1 and the insulator 2.

Referring to FIGS. 3-6, the insulative housing 1 defines a mating port (not labeled) and includes a base portion 11 and a tongue portion 12 extending forwardly from a front end of the base portion 11 and into the mating port. The base portion 11 has a first portion 111 defining a retaining slot 1110 for receiving the insulator 2 and a pair of side walls 113 located at two lateral sides of the retaining slot 1110, and a second portion 112 extending backwardly from the first portion 111. The first portion 111 and the second portion 112 form as a ladder shape which can be presented explicitly in FIG. 6.

Referring to FIGS. 3-6, the first portion 111 has a first opening 1112 passing therethrough in a height direction of the insulative housing 1 and communicating with the retaining slot 1110, a vertical face 1120 facing the retaining slot 1110, and a set of embossments 1113 protruding into the retaining slot 1110 and located between the first opening 1112 and the vertical face 1120. The second portion 112 has a horizontal upper face 1121 perpendicular to the vertical face 1120, a plurality of ribs 1122 protruding upwardly from the upper face 1121, and a plurality of cavities 1123 exposed to exterior and formed between each two adjacent ribs 1122. The second portion 112 has a pair of second bumps 1125 protruding upwardly and outwardly therefrom, and a first bump 1124 protruding upwardly from the upper face 1121 and located between the second bumps 1125 in a transverse direction perpendicular to the front-to-back direction. The first bump 1124 is higher than the second bumps 1125 and has a pair of securing slots 11242 formed at two lateral sides thereof for retaining the metal shell 4.

The tongue portion 12 has a number of projections 122 spaced from each other in the transverse direction and forms a number of passageways 123 between each two adjacent projections 122. The insulator 2 is retained between the embossments 1113 and the projections 122 in the front-to-back direction.

Referring to FIGS. 2-6, the contacts 3 are adapted for USB 3.0 protocol, and include a number of first contacts 31 and a number of second contacts 32. The first contacts 31 are adapted for USB 2.0 protocol and connected by two contact carriers (not shown) before the first contacts 31 being made out. The first contacts 31 are insert molded into the insulative housing 1. The two contact carriers were cut off from the first opening 1112 and a second opening 125 passing through the tongue portion 12 in the height direction so that the first contacts 31 could be separated from each other. The first contacts 31 include stiff first contacting portions 312 retained in the tongue portion 12 and exposed to the interface 101, first connecting portions 311 bending downwardly and extending backwardly from back ends of the first contacting portions 312, first bending portions 314 bending upwardly from back ends of the first connecting portions 311, first offset portions 313 extending backwardly from the first connecting portions 311 and offsetting horizontally, and first tail portions 315 connecting the first offsetting portions 313 and extending backwardly beyond the second portion 112. The second contacts 32 include resilient second contacting portions 322 received in the passageways 123 of the tongue portion 12, second connecting portions 321 extending backwardly from back ends the second contacting portions 322 and retained in retaining holes 24 passing through the insulator 2 in the front-to-back direction, second bending portions 324 bending upwardly from the second connecting portions 321 and extending through a space formed between the vertical face 1120 and the insulator 2, second offset portions 323 extending backwardly and offsetting horizontally, and second tail portions 325 connecting the second offset portions 323 and extending backwardly beyond the second portion 112. The second offset portions 323 are retained in the cavities 1123 of the second portion 112. In this embodiment, the second contacts 32 are assembled to the insulator 2 so as to form a module retained in the insulative housing 1, In other embodiments, the second contacts 32 could be insert molded into the insulator 2 to form a module retained in the insulative housing 1.

The first contacts 31 include a first grounding contact 51, a power contact 56, and a first pair of differential contacts 53 located between the first grounding contact 51 and the power contact 56. The first offset portions 313 of the first grounding contact 51 and the power contact 56 offset oppositely along the transverse direction, therefore, a distance measured between the first tail portions 315 of the first grounding contact 51 and the power contact 56 is greater than a distance measured between the corresponding first contacting portions 312 or the corresponding first connecting portions 311. The first offset portions 313 of the first pair of differential contacts 53 offset toward each other in the transverse direction, therefore, a distance measured between the first tail portions 315 of the first pair of differential contacts 53 is smaller than a distance measured between the corresponding first contacting portions 312 or the corresponding first connecting portions 311.

The second contacts 32 include a second pair of differential contacts 54, a third pair of differential contacts 55, and a second grounding contact 52 located between the second and third pairs of differential contacts 54, 55. The second offset portions 323 of the second pair of differential contacts 54 offset toward each other in the transverse direction, therefore, a distance measured between the second tail portions 325 of the second pair of differential contacts 54 is smaller than a distance measured between the corresponding second contacting portions 322 or the corresponding second connecting portions 321. Similarly, the second offset portions 323 of the third pair of differential contacts 55 offset toward each other in the transverse direction, therefore, a distance measured between the second tail portions 325 of the second pair of differential contacts 54 is smaller than a distance measured between the corresponding second contacting portions 322 or the corresponding second connecting portions 321. The second bending portion 324 of the second grounding contact 52 has a width wider than those of the remaining second bending portions 324 and defines a through hole 3241 passing therethrough in the front-to-back direction. The second offset portion 323 of the second grounding contact 52 has a width wider than that of the second bending portion 324 and defines two split said second tail portions 325 spaced from each other in the transverse direction. The second bump 1125 is located between the two second tail portions 325 of the second grounding contact 52.

Figure 4:
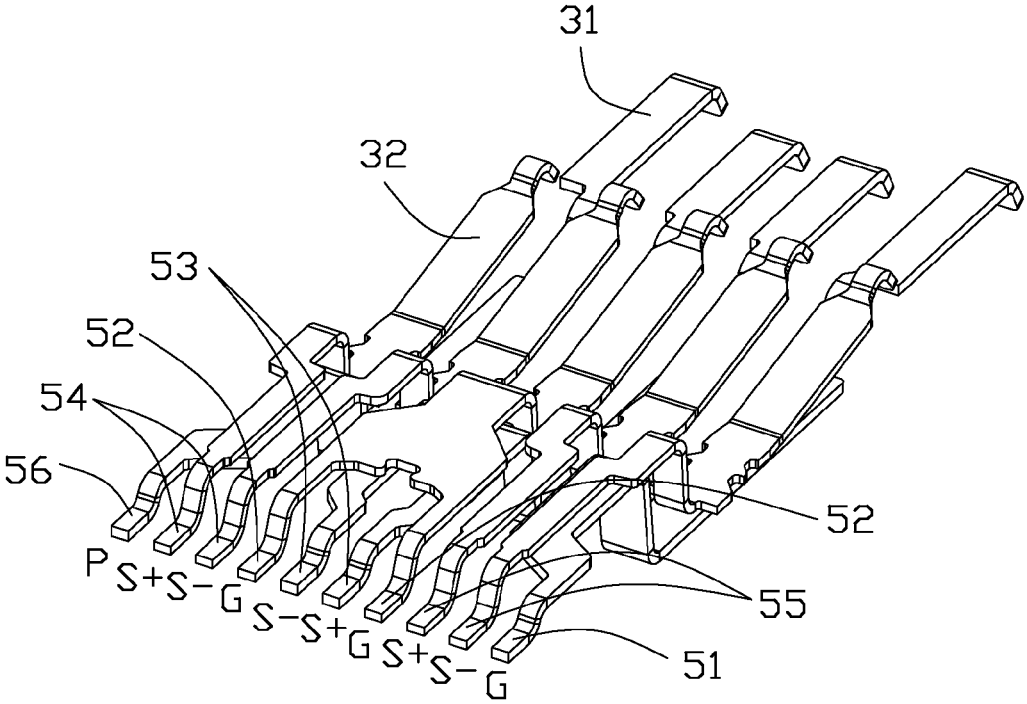
FIG. 4 is a perspective view of contacts separated from the connector shown in FIG. 1.
Figure 5:
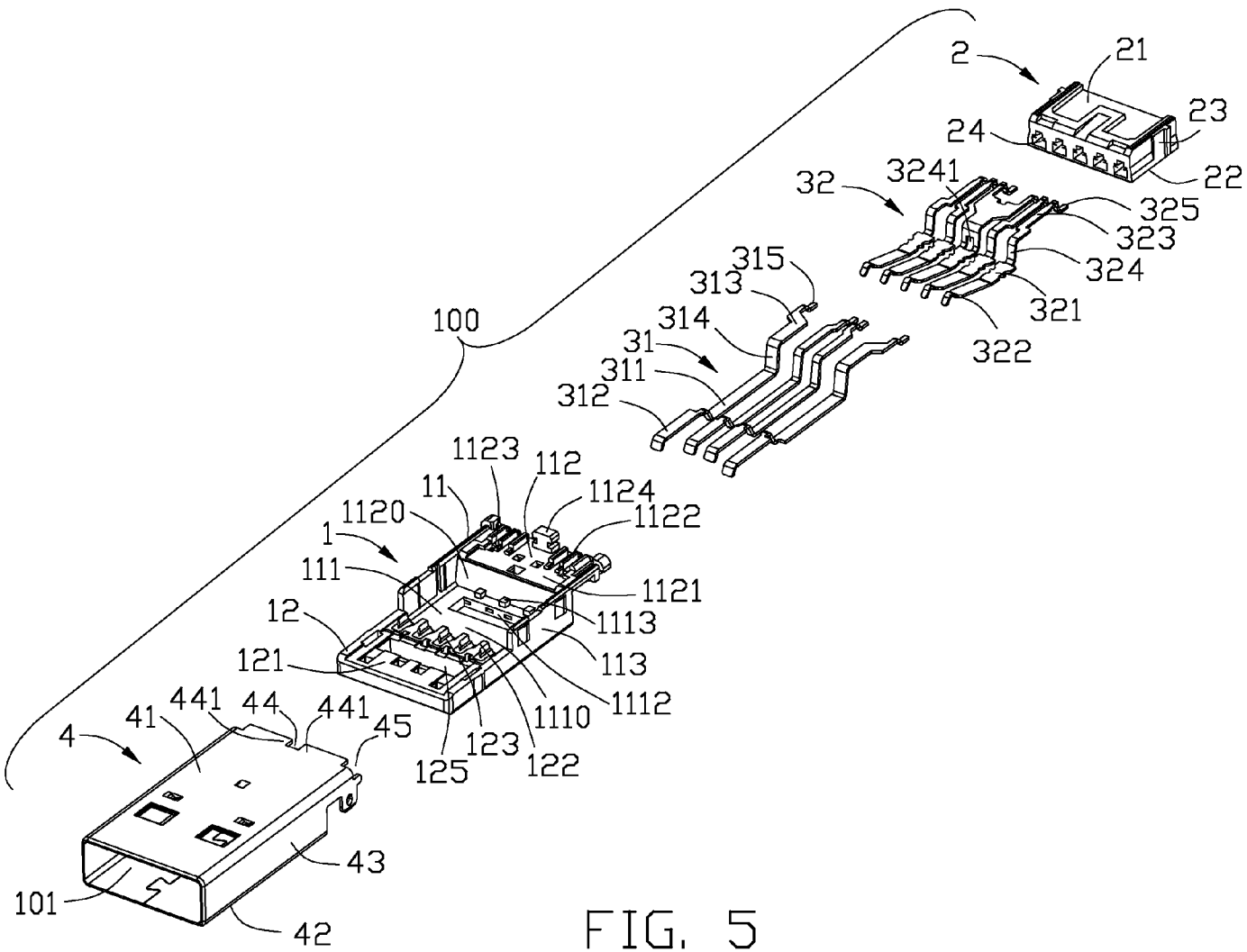
FIG. 5 is an exploded view of the connector shown in FIG. 1.
Figure 6:
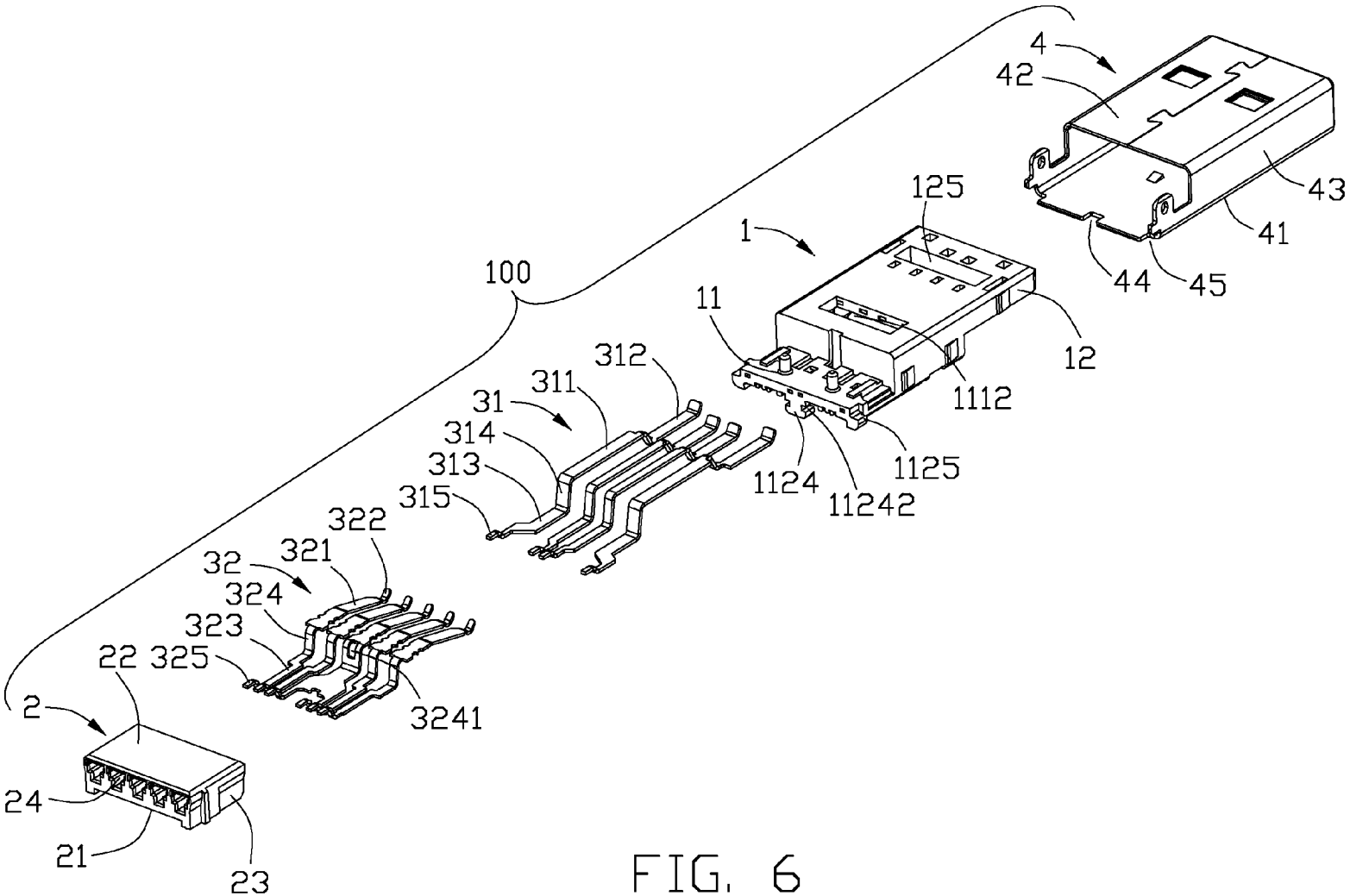
FIG. 6 is similar to FIG. 5, but viewed from another aspect.

The first and second tail portions 315, 325 are arranged in one row, all of the second tail portions 325 are arranged between the first tail portions 315 of the first grounding contact 51 and the power contact 56. In another word, relative to the first and second tail portions 315, 325, the first grounding contact 51 and the power contact 56 are arranged at two outermost sides. The second tail portions 325 of the second pair of differential contacts 54 are arranged between the first tail portion 315 of the power contact 56 and one second tail portion 325 of the second grounding contact 52, the second tail portions 325 of the third pair of differential contacts 55 are arranged between the first tail portion 315 of the first grounding contact 51 and the other second tail portion 325 of the second grounding contact 52. Referring to FIG. 4, all of the first and second tail portions 315,325 viewed from a back view and a left-to-right direction are arranged in the following specific sequence: power contact 56 (P)、the second pair of differential contacts 54 (S+, S−) 、the second grounding contact 52 (G)、the first pair of differential contacts 53 (S−, S+) 、the second grounding contacts 52 (G)、the third pair of differential contacts 55 (S+, S−)、the first grounding contact 51 (G). Therefore, in the first and second tail portions 315, 325, each adjacent two pairs of the first, second and third pairs of differential contacts 53, 54, 55 has a grounding contact 52 located therebetween, the space between the first, second and third pairs of differential contacts 53, 54, 55 can be increased, the interference between the first, second and third pairs of differential contacts 53, 54, 55 can be reduced more effectively.

Referring to FIGS. 1-6, the metal shell 4 surrounds the tongue plate 12 to form the interface 101 and includes a top plate 41, a bottom plate 42 and a pair of side plates 43 connecting the top and bottom plates 41, 42. The metal shell 4 has a first notch 44 formed in a back side of the top plate 41 and engaging with the first bump 1124, and a pair of second notches 45 formed between the top plate 12 and two side plates 43 and engaging with the corresponding second bumps 1125. The second bumps 1125 are received in the corresponding second notches 45 and resist the metal shell 4 forwardly, inwardly and downwardly. The first bump 1124 is received in the first notch 44. The top plate 41 has two securing portions 441 on two sides of the first notch 44 retained in securing slots 11242 formed on the first bump 1124 so that the top plate 41 could be orientated in the first bump 1124 in the height direction. Therefore, the second portion 112 has two sides resisted upwardly and outwardly by the metal shell 4 via the second bumps 1125 cooperating with the second notches 45, and a midst portion orientated along the height direction by the metal shell 4 via the first bump 1124 cooperating with the first notch 44, the second portion 112 could be presented from warp along the height direction, and the first and second tail portions 315, 325 will be preferably coplanar in a horizontal plane for being soldered to a printed circuit board reliably. In another embodiment, the first bump 1124 could have only one said securing slot 11242 formed thereon, the top plate 41 has one said securing portion 441 extending backwardly from a rear end thereof and being retained in said securing slot 11242.

Figure 7:
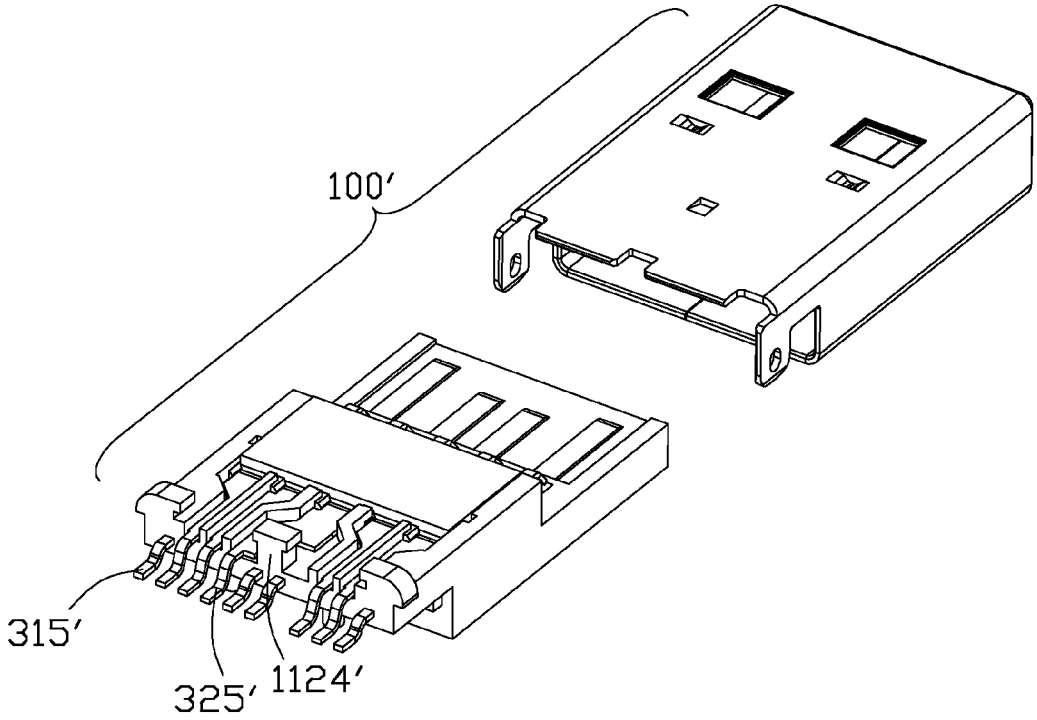
FIG. 7 is partially exploded view of a connector according to a second embodiment of the present invention.
Figure 8:
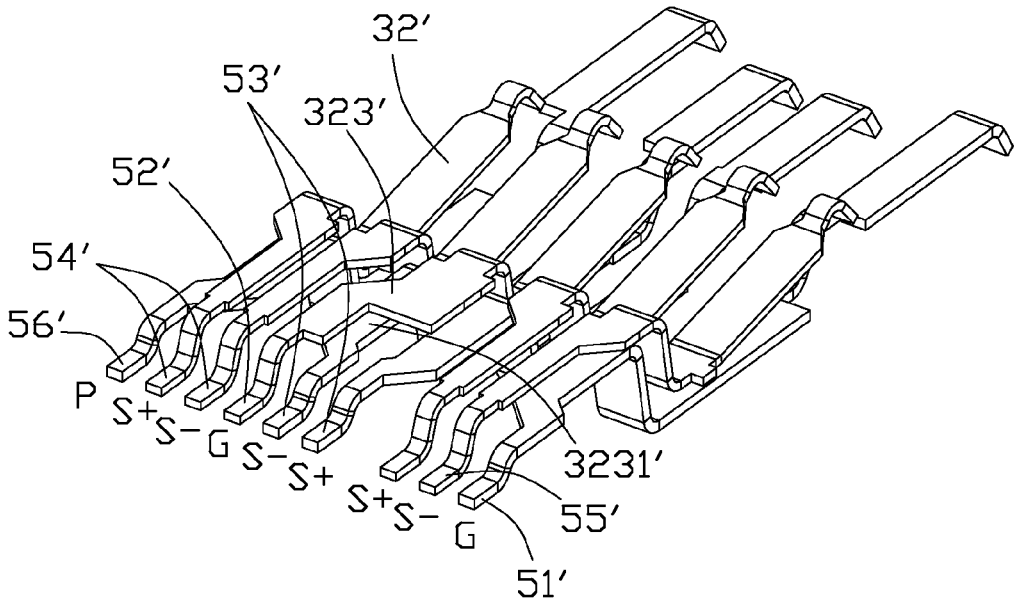
FIG. 8 is a perspective view of contacts separated from the connector shown in FIG. 7.

Referring to FIGS. 7 and 8, a connector 100' according to a second embodiment of the present invention. A second grounding contact 52' is different from the second grounding contact 52 of the first embodiment and has only one second tail portion 325' extending from the second offset portion 323'. The second tail portion 325' of the second grounding contact 52' is located between the second tail portions 325' of the second pair of differential contacts 54' and the first tail portions 315' of the first pair of differential contacts 53'. The second offset portion 323' has a cutout 3231' formed on a right side thereof for the first bump 1124' passing through. Therefore, in the second embodiment of the present invention, all of the first and second tail portions 315', 325' viewed from a back view and a left-to-right direction are arranged in the following specific sequence: power contact 56' (P)、the second pair of differential contacts 54' (S+, S−)、the second grounding contact 52' (G)、the first pair of differential contacts 53' (S−, S+)、the third pair of differential contacts 55' (S+, S−) and the first grounding contact 51' (G).

Figure 9:
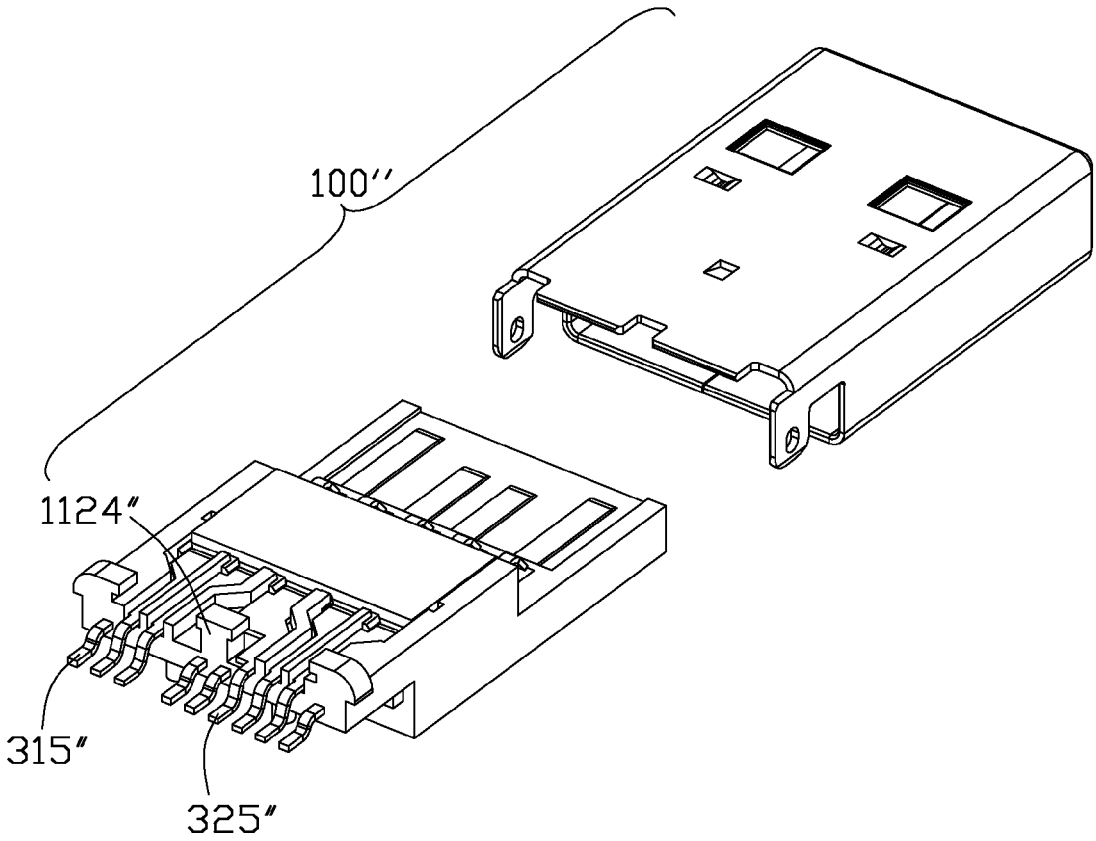
FIG. 9 is partially exploded view of a connector according to a third embodiment of the present invention.
Figure 10:
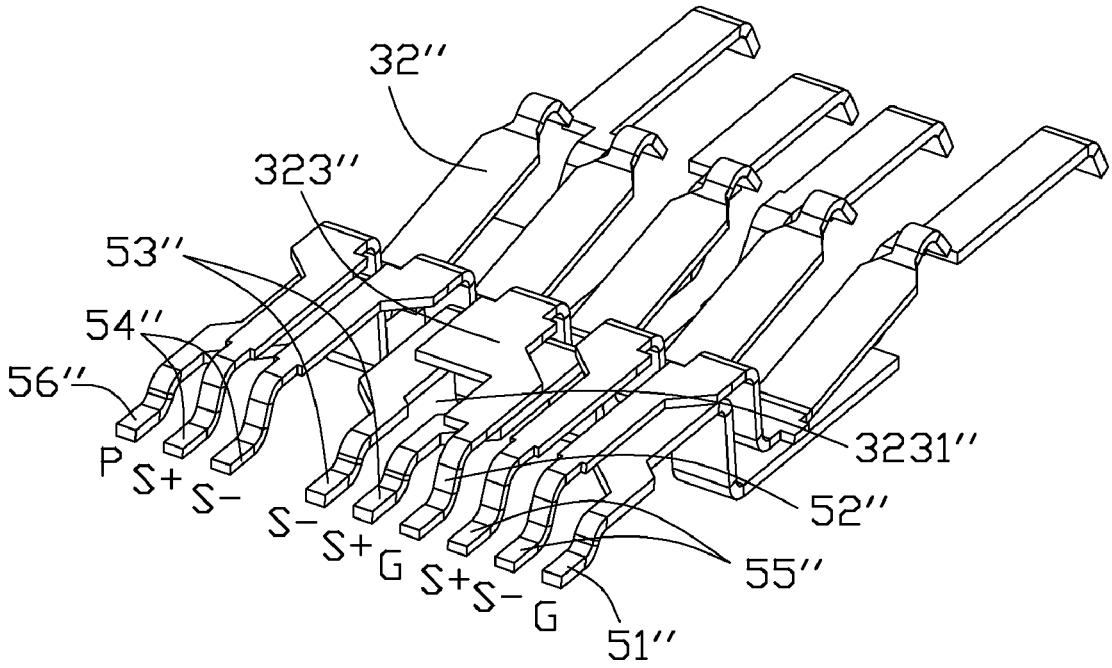
FIG. 10 is a perspective view of contacts separated from the connector shown in FIG. 9.

Referring to FIGS. 9 and 10, a connector 100" according to a third embodiment of the present invention. A second grounding contact 52" is different from the second grounding contact 52 of the first embodiment and the second grounding contact 52' of the second embodiment. The second grounding contact 52" has only one second tail portion 325" extending from the second offset portion 323" and located between the second tail portions 325" of the third pair of differential contacts 55" and the first tail portions 315" of the first pair of differential contacts 53". The second offset portion 323" has a cutout 3231" formed on a left side thereof for the first bump 1124" passing through. Therefore, in the third embodiment of the present invention, all of the first and second tail portions 315", 325" viewed from a back view and a left-to-right direction are arranged in the following specific sequence: power contact 56" (P)、the second pair of differential contacts 54" (S+, S−)、the first pair of differential contacts 53" (S−, S+)、the second grounding contact 52" (G)、the third pair of differential contacts 55" (S+, S−) and the first grounding contact 51" (G).

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An USB connector comprising:

an insulative housing defining a mating port;

a plurality of first contacts disposed in the insulative housing and comprising a power contact, a first grounding contact and a first pair of differential contacts located between the power contact and the first grounding contact, each of said first contacts comprising a first contacting portion exposed in the mating port and a first tail portion opposite to the first contacting portion; and a plurality of second contacts disposed in the insulative housing and being configured essentially different from the first contacts, the second contacts comprising a second pair of differential contacts, a third pair of differential contacts, and a second grounding contact located between the second and third pairs of differential contacts, each of said second contacts comprising a second contacting portion exposed in the mating port and essentially located at a different level with regard to the first contacting portion, and a second tail portion opposite to the second contacting portion; wherein the first and second tail portions are arranged in one row in a transverse direction under a condition that all of the second tail portions are located between the first tail portions of the power contact and the first grounding contact in said transverse direction.

2. The connector according to claim 1, wherein relative to the first and second tail portions, the first and second contacts are arranged in the following specific sequence: the power contact, the second pair of differential contacts, the second grounding contact, the first pair of differential contacts, the third pair of differential contacts, and the first grounding contact.

3. The connector according to claim 1 wherein relative to the first and second tail portions, the first and second contacts are arranged in the following specific sequence: the power contact, the second pair of differential contacts, the first pair of differential contacts, the second grounding contact, the third pair of differential contacts, and the first grounding contact.

4. The connector according to claim 1, wherein the first contacts are insert molded into the insulative housing, the connector further comprises an insulator assembled to the insulative housing and defining a plurality of retaining holes for retaining the second contacts.

5. The connector according to claim 1, wherein the first contacts comprise first offset portions connecting the first tail portions and located between the first contacting and tail portions, the first offset portions of the first pair of differential contacts offset toward each other in the transverse direction so that a distance measured between the first tail portions of the first pair of differential contacts is smaller than a distance measured between the corresponding first contacting portions, the first offset portions of the power contact and the first grounding contact offset opposed to each other in the transverse direction so that a distance measured between the first tail portions of the power and first grounding contacts is greater than a distance measured between the corresponding first contacting portions.

6. The connector according to claim 5, wherein the second contacts comprise second offset portions connecting the second tail portions and located between the second contacting and tail portions, the second offset portions of each of the second and third pairs of differential contacts offset toward each other in the transverse direction so that a distance measured between the second tail portions of each of the second and third pairs of differential contacts is smaller than a distance measured between the corresponding second contacting portions.

7. The connector according to claim 1, wherein the second grounding contact comprising a pair of said second tail portions spaced from each other in the transverse direction and arranged at two sides of the first tail portions of the first differential contacts respectively.

8. The connector according to claim 7, wherein relative to the first and second tail portions, the first and second contacts are arranged in the following specific sequence: the power contact, the second pair of differential contacts, the second grounding contact, the first pair of differential contacts, the second grounding contact, the third pair of differential contacts, and the first grounding contact.

9. The connector according to claim 7, wherein the insulative housing has a bump protruding therefrom and defining at least one securing slot, the connector further comprises a metal shell shielding the insulative housing, the metal shell defining at least one securing portion formed thereon and being retained in the at least one securing slot so as to lock with the bump upwardly and downwardly, the bump is located between said two second tail portions of the second grounding contact.

10. The connector according to claim 7, wherein the second tail portions of the second pair of differential contacts are arranged between the first tail portion of the power contact and one second tail portion of the second grounding contact.

11. The connector according to claim 10, wherein the second tail portions of the third pair of differential contacts are arranged between the first grounding contact and the other second tail portion of the second grounding contact.

12. An USB 3.0 plug connector comprising:

an insulative housing having a base portion and a tongue portion extending forwardly from the base portion; and a plurality of USB 3.0 contacts coupled to the insulative housing and comprising a plurality of first contacts adapted for USB 2.0 protocol and a plurality of second contacts, the first contacts comprising a power contact, a first grounding contact and a first pair of differential contacts located between the power contact and the first grounding contact, each of said first contacts comprising a stiff first contacting portion retained in the tongue portion and a first tail portion opposite to the first contacting portion; the second contacts comprising a second pair of differential contacts, a third pair of differential contacts, and a second grounding contact located between the second and third pairs of differential contacts, each of said second contacts comprising a resilient second contacting portion extending upon the tongue portion under a condition that the second contacting portions are located behind the first contacting portions, and a second tail portion opposite to the second contacting portion; wherein the first and second tail portions are arranged in one row in a transverse direction, the second grounding contact has two split said second tail portions spaced from each other in said transverse direction, the first tail portions of the first pair of differential contacts are arranged between and directly neighboring to said second tail portions of the second grounding contact.

13. The USB 3.0 plug connector according to claim 12, wherein the connector further comprises a metal shell shielding the insulative housing, the insulative housing has a bump protruding therefrom for retaining the metal shell and located between said two second tail portions of the second grounding contact.

14. The USB 3.0 plug connector according to claim 12, wherein relative to the first and second tail portions, the first and second contacts are arranged in the following specific sequence: the power contact, the second pair of differential contacts, the second grounding contact, the first pair of differential contacts, the second grounding contact, the third pair of differential contacts, and the first grounding contact.

15. The USB 3.0 plug connector according to claim 12, wherein the second tail portions of the second pair of differential contacts are arranged between the first tail portion of the power contact and one second tail portion of the second grounding contact.

16. The USB 3.0 plug connector according to claim 15, wherein the second tail portions of the third pair of differential contacts are arranged between the first grounding contact and the other second tail portion of the second grounding contact.

17. An USB electrical connector comprising:

an insulative housing enclosed in a metallic shell commonly defining a mating port with a mating tongue extending therein in a front-to-back direction and defining a mating face thereon;

four first contacts disposed in the housing and comprising a first grounding contact, a pair of first differential pair contacts and a power contact arranged with one another in a transverse direction perpendicular to said front-to-back direction, each of the first contacts defining a front first contacting section exposed upon the mating face, and a rear first tail section located on a rear side of the housing;

five second contacts disposed in the housing and comprising a pair of second differential pair contacts, a second grounding contact and a pair of third differential pair contacts arranged with each other in said transverse direction, each of said second contacts defining a front second contacting section exposed upon the mating face and a rear second tail section located on the rear side of the housing under condition that the front first contacting sections and the front second contacting sections are essentially located at different levels in a vertical direction perpendicular to both said front-to-back direction and said transverse direction, and essentially offset from each other in the front-to-back direction; wherein the first tail sections and the second tail sections are arranged in one row along the transverse direction corresponding to first to tenth positions with generally equal intervals under condition that all the differential pair contacts composed of the pairs of first, second and third differential pair contacts, occupy a second position, a third position, a fifth position, a sixth position, a eight position and a ninth position.

18. The electrical connector as claimed in claim 17, wherein the second grounding contact occupies at least one of a fourth position and a seventh position while the power contact and the first grounding contact occupy the first position and the tenth position, respectively.

19. The electrical connector as claimed in claim 18, wherein during mating one of the front first contacting section of the first contact and the front second contacting section of the second contact is deflectable while the other is still.

* * * * *